US006607659B2

(12) United States Patent
Hensley et al.

(10) Patent No.: US 6,607,659 B2
(45) Date of Patent: Aug. 19, 2003

(54) DRILLING MUD RECLAMATION SYSTEM WITH MASS FLOW SENSORS

(75) Inventors: Gary L. Hensley, Kingwood, TX (US); Lee Hilpert, Livingston, TX (US)

(73) Assignee: Hutchison-Hayes International, Inc., Houston, TX (US)

( * ) Notice: Subject to any disclaimer, the term of this patent is extended or adjusted under 35 U.S.C. 154(b) by 0 days.

(21) Appl. No.: 09/740,692

(22) Filed: Dec. 19, 2000

(65) Prior Publication Data

US 2002/0074269 A1 Jun. 20, 2002

(51) Int. Cl.[7] ..... B04C 11/00; E21B 21/00

(52) U.S. Cl. ..... 210/87; 209/726; 209/729; 175/206; 175/48; 210/87; 210/97; 210/167; 210/170; 210/252; 210/512.2

(58) Field of Search ..... 494/10, 32, 35, 494/85; 210/85, 87, 97, 167, 170, 195.3, 252, 259, 322, 369, 512.2; 175/66, 217, 48, 206, 207, 24, 40; 340/613, 618–621; 209/729, 726, 10

(56) References Cited

U.S. PATENT DOCUMENTS

| | | | | |
|---|---|---|---|---|
| 2,870,990 | A | | 1/1959 | Bergey |
| 3,070,291 | A | | 12/1962 | Bergey |
| 3,500,943 | A | * | 3/1970 | Bingman |
| 3,737,037 | A | | 6/1973 | Bone, III |
| 3,964,557 | A | | 6/1976 | Juvkam-Wold |
| 4,413,511 | A | * | 11/1983 | Godbey |
| 4,482,459 | A | | 11/1984 | Shiver |
| 4,571,296 | A | | 2/1986 | Lott |
| 4,670,139 | A | | 6/1987 | Spruiell et al. |
| 5,107,874 | A | | 4/1992 | Flanigan et al. |
| 5,129,469 | A | | 7/1992 | Jackson |
| 5,145,256 | A | * | 9/1992 | Wiemers et al. |
| 5,190,645 | A | | 3/1993 | Burgess |
| 5,344,570 | A | | 9/1994 | McLachlan et al. |
| 5,454,957 | A | | 10/1995 | Roff |
| 5,494,584 | A | | 2/1996 | McLachlan et al. |
| 5,857,955 | A | | 1/1999 | Phillips et al. |
| 5,882,524 | A | | 3/1999 | Storey et al. |
| 6,036,870 | A | * | 3/2000 | Briant et al. |
| 6,073,709 | A | * | 6/2000 | Hensley |
| 6,110,367 | A | * | 8/2000 | Jensen et al. |
| 6,110,382 | A | * | 8/2000 | Wiemers et al. |

* cited by examiner

*Primary Examiner*—Joseph Drodge
*Assistant Examiner*—Terry K. Cecil
(74) *Attorney, Agent, or Firm*—Browning Bushman P.C.

(57) ABSTRACT

A drilling mud clarification or reclamation system is provided. High gravity and low gravity solids are removed from the drilling mud in respective centrifugal separator stages. A plurality of in-line mass flow sensors are provided to provide real-time indication of the effectiveness of the clarification of the drilling mud, and to provide control signals to a central control station. The heavier weight components are separated from the mud and returned to the system for further use. The lighter weight components are removed and are discarded to clean the mud. A cuttings dryer is provided to remove oil from cuttings which have been separated from a shale shaker stage. A de-sludging centrifuge is also provided to remove very fine cuttings which may have a harmful effect on the viscosity of the mud.

24 Claims, 5 Drawing Sheets

DRILLING MUD RECLAMATION SYSTEM WITH MASS FLOW SENSORS

BACKGROUND OF THE INVENTION (1) Field of the Invention

The present invention relates generally to fluid clarification systems and, more particularly, to a system and method of treating drilling mud, while retaining certain desirable solids in the fluid so that the fluid can be subsequently used. Further, the present invention relates to a fluid clarification system including a subsystem for dynamically measuring mass flow rate. The present invention further provides a purification step, preferably using a vertical centrifuge, that removes fine suspended solids which have in the past been returned to the drilling mud system.

(2) Description of Related Art

The present invention provides a drilling mud treatment system used with a drilling rig. When an oil well is drilled, it is necessary to drill the well with drilling fluid, commonly referred to in the art as drilling mud. The drilling mud is provided to lubricate and cool the drill bit and to carry away cuttings as the mud flows upwardly in the annular flow space around the drill string. The drilling mud is pumped down the drill string to pick up the cuttings and other debris. Commonly, the drilling mud is either water or an oil-based carrier.

When drilling into a high pressure formation or at great depths, safety is enhanced by incorporating a weight component, such as barium sulfate, barite, or hematite, for example, to the drilling mud to increase the weight of the drilling mud. The additives are expensive and various systems have been proposed for the recovery and recycling of drilling mud additives. Also, when drilling mud circulates through the well it picks up particles or cuttings of the earth formations cut by the drill bit. Various systems have therefore been proposed to remove the cuttings from the drilling mud so that the drilling mud can be recycled for further use in drilling operations.

It is relatively easy to clean the drilling mud if the cuttings are primarily heavy rock. Also, large particle cuttings are easily removed from the mud by passing the drilling mud through a set of screens and other components, such as including shale shakers, desanders, degassers, and other cleaning devices. As used herein, such early-stage cuttings separators are referred to as coarse cuttings separators. Centrifuge systems are often used to further treat drilling mud by removing the finer cuttings. Unfortunately, very fine low density solids, which are not as easily removed from the drilling mud, have simply been accepted in the past and the drilling mud has been routinely returned to the mud system with such very fine solids entrained in the mud. This practice is particularly deleterious to the mud system because the very fine solids have an adverse impact on the viscosity of the drilling mud. Thus, there remains a need for further treatment of drilling mud to remove these very fine suspended low gravity solids, while returning drilling mud additives to the drilling mud system.

There is a direct economic benefit in removing as much of the undesirable solids from the drilling mud while retaining the additives in the mud. The natural inclination of operators of drilling mud treatment systems in the field is to maximize the flow rate of drilling mud through the system. However, running the system at maximum flow rate does not necessarily remove the greatest amount of the cuttings. So, there remains a need for a system with installed controls to operate the system for the maximum efficiency in the removal of the cuttings from the drilling mud. Further, there remains a need for a system which demonstrates the cost savings to the operator if the system is operated at such a maximum efficiency operating point. Such a system should provide a dynamic measurement of mass flow throughout the system in order for operators to determine the most efficient flow through the system.

In our co-pending U.S. patent application Ser. No. 09/579,702, filed May 26, 2000, incorporated herein by reference, we described a batch system for measuring mass flow through the system. That batch system was based on the realization that measuring the rate of change of volume in a measurement tank, and the concomitant change in the weight at two measured volumes of drilling mud, provided a direct measurement of mass flow rate in the system. Measurement of mass flow at two points in the treatment system provided a technique for measuring the efficiency of the system in removing undesirable solids from the drilling mud. The present invention improves on that technique by providing in-line measurement surge tanks in the treatment system to dynamically measure mass flow rate at selected points in the system. The present invention eliminates the need for batch measurement of mass flow rate by sampling outside the treatment system.

The present invention is further directed to another long felt need in the drilling art. It is known that mud systems are not completely effective in cleaning all the drill cuttings from down hole. Consequently, cuttings tend to build up down hole over time, and periodically operators typically stop the drilling operation and increase mud flow rate, sometimes as much as double the usual flow rate, to clean out the accumulated cuttings. This is known in the art as "sweeping" the well. With current mud systems, however, there is no way to tell how long to "sweep" the well, since there is currently no effective way to determine total solids removed by current mud purification systems. Consequently, operators tend to either under sweep a well, and thereby do an inadequate job of removing accumulated cuttings, or they tend to over sweep a well, losing valuable drilling time at substantial expense. The present invention addresses this need in the art.

SUMMARY OF THE INVENTION

The present invention addresses these and other needs in the art by providing an additional stage in the treatment system, in addition to that shown and described on our application Ser. No. 09/579,702, for maximum efficiency in removing these undesirable very fine, low gravity solid components. The system comprises a primary decanter centrifuge adapted for the removal of high density solids, the type commonly added to drilling mud as weight components. The liquids discharge of the primary decanter centrifuge is fed to the inlet of a secondary decanter centrifuge, which is adapted to remove low gravity cuttings from the drilling mud. The solids discharge of the primary decanter centrifuge is recirculated back to the mud system for reuse. The liquids discharge of the secondary decanter centrifuge is preferably directed back to the system for reuse, although a portion of the liquids discharge from the secondary decanter centrifuge may be directed to the influent of a cuttings dryer, as shown and described in our U.S. patent application Ser. No. 09/620,844, filed Jul. 21, 2000, now U.S. Pat. No. 6,432,299, and incorporated herein by reference. The cuttings dryer is available from Hutchison-Hayes International under the trademark DUSTER™. The cuttings dryer further treats the drilling mud, reducing the drilling fluids associated with the solids to a point where the solids can be safely discharged within government regulations for discharge of oil-based drilling mud offshore.

The liquids discharge of the cuttings dryer is directed to the inlet of a dryer recovery decanter centrifuge for further treatment. The liquids discharge of the dryer recovery decanter centrifuge may preferably be directed to a de-sludging high speed vertical disc centrifuge, available from Hutchison-Hayes as model number SEA-1200. The vertical disc centrifuge removes the very fine low gravity solids which can adversely effect the viscosity of the drilling mud if recycled to the drilling mud system. The liquids from the vertical disc centrifuge are returned to the drilling mud system.

The present invention provides the additional feature of a plurality of mass balance units in the drilling mud flow path at selected points in the system. The mass balance units provide a direct measurement of the solids being removed by the various centrifuges and the cuttings dryer in the system, so that the system controls maintain the operating points for the system for the maximum efficiency in the removal of undesirable cuttings from the drilling mud.

These and other features and advantages of the present invention will be apparent to those skilled in the art from a review of the following detailed description along with the accompany drawings.

BRIEF DESCRIPTION OF THE DRAWINGS

The appended drawings illustrate only typical embodiments of this invention and are therefore not to be considered limiting of its scope, for the invention may admit to other equally effective embodiments.

DETAILED DESCRIPTION OF PREFERRED EMBODIMENTS

Figure 1:
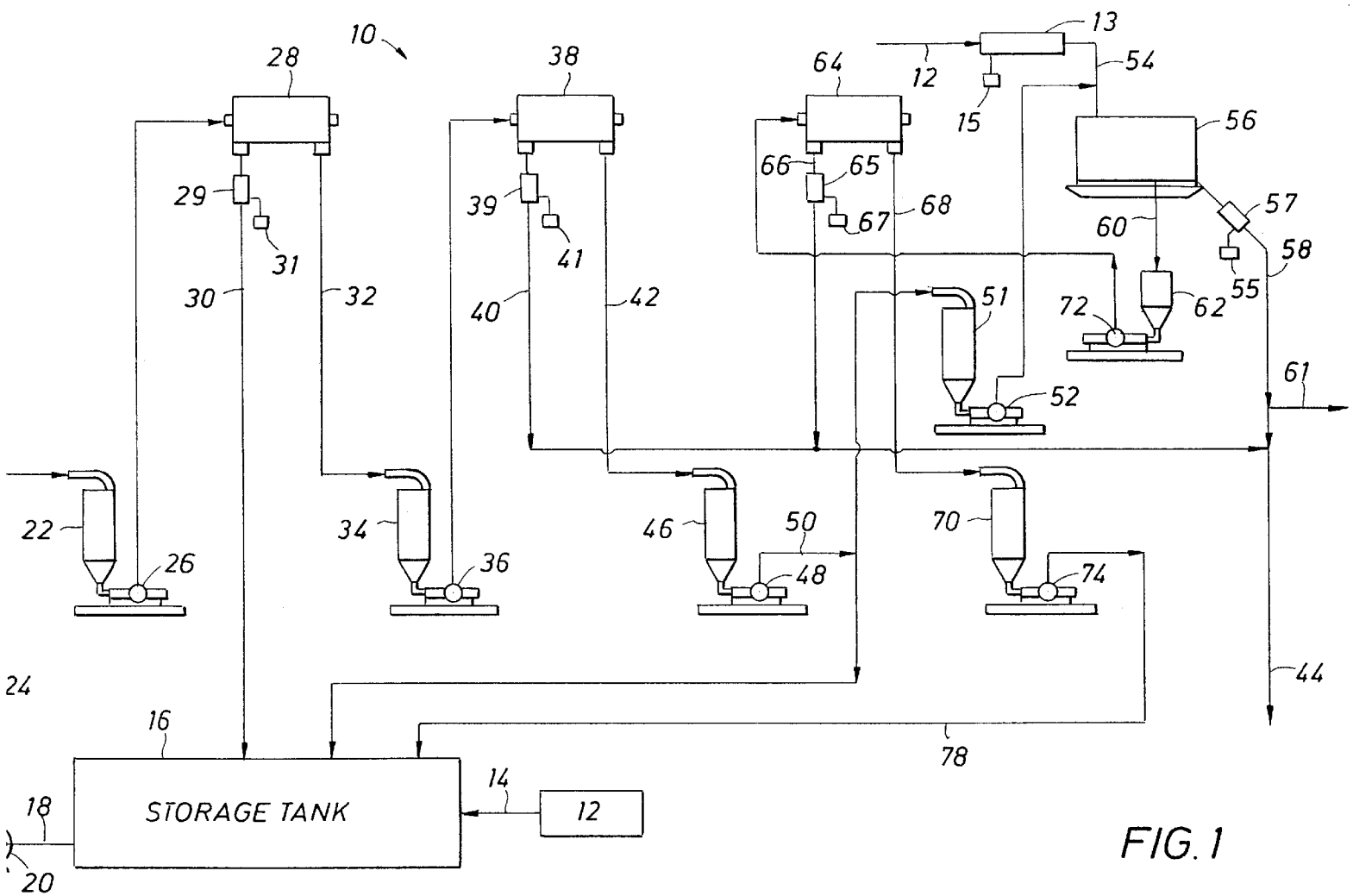
FIG. 1 is an overall schematic diagram of the drilling mud treatment system of this invention, including a plurality of in-line mass balance units.

FIG. 1 depicts a mud clarification or processing system 10 of the present invention. The system is temporarily assembled adjacent to a drilling rig (not shown) and typically includes a set of mud pits which receive the used mud from the well borehole. The mud delivered to the mud pits is transferred to a shale shaker. The supply line from the shale shaker is shown schematically in FIG. 1 with the reference number 12. The shale shaker picks up large particles which are collected on a screen in the shale shaker for removal from the mud. From the shale shaker, a mud line 14 is connected into the system 10.

Cuttings from the shale shaker are transferred into the system of FIG. 1 by way of a mass flow sensor 13, which is preferably a screw-type conveyor or auger, into an inlet line 54. Mass flow of the cuttings into the system is determined by a load sensor 15 and the scroll rate of the conveyor. In this way, the contribution of the shale shaker to the total low gravity solids processed by the system can be determined. Combining this determination with the low gravity solids processed by the remainder of the system provides an indication of total cuttings, and thus an indication of the effectiveness of the mud system in flushing cuttings from the hole. This also provides an indicator of when a sweep needs to be performed on the hole, and for how long.

The principle components of the system will now be described. Supply of drilling mud enters the system from the mud line 14 into a storage tank 16, although it should be understood that a plurality of such storage tanks are preferably used. Drilling mud from the storage tank 16 is directed through a supply line 18 into a first positive displacement pump 20.

Mud is pumped by the pump 20 into the inlet of a first mass flow sensor 22 by way of a supply line 24. The operation of the mass flow sensor will be described below with regard to FIGS. 3*a,* 3*b,* and 3*c*. The mud is then pumped from the mass flow sensor 22 by a pump 26 into a first stage centrifuge 28. As previously described, the first stage centrifuge is controlled to separate the desirable, heavy components which have been added to the drilling mud, while passing the lighter weight cuttings.

As viewed in FIG. 1, a solids discharge 30 from the centrifuge 28 is on the left, and a liquids discharge 32 is on the right. The solids discharge 30, including the high value, high gravity solids, is returned to the tank 16, thereby restoring the high gravity solids to the system for further use. The liquids discharge 32 is directed to a second mass flow sensor 34. The mud is then pumped by a pump 36 into a second stage centrifuge 38 which is controlled to remove low gravity solids, i.e. cuttings, from the mud. As before with regard to the first stage centrifuge 28, a solids discharge 40 from the second centrifuge is depicted on the left in FIG. 1 and a liquid discharge 42 is depicted on the right. The solids discharge 40 is directed to a disposal line 44 for discharge. It should be understood that, although the solids discharge disposal line 44 is shown as a single line, the system may include a number of such discharge lines over the side or into a capture system. The liquid discharge 42 is directed to a third mass flow sensor 46.

From the third mass flow sensor 46, the now substantially clarified drilling mud is pumped by a pump 48 into a line 50 where the mud may be directed to the tank 16 and/or to a fourth mass flow sensor 51 and then to the suction of a booster pump 52. The booster pump 52 directs the flow to a cuttings inlet line 54 where cuttings from the shale shakers are received. The cuttings inlet line 54 flows into a cuttings dryer 56, as previously described. The solids from the cuttings dryer 56 are directed to a solids discharge line 58 and to the disposal line 44 for discharge, and the liquids from the cuttings dryer 56 are directed to a liquid discharge line 60 and to a fifth mass flow sensor 62. Alternatively, the cuttings dryer 56 may be provided with a discharge line 61, separate from the disposal line 44, to direct its solids discharge for disposal. From the mass flow sensor 62, the mud is pumped to a third stage centrifuge 64. The solids from the third stage centrifuge 64 are directed to a solids discharge line 66 and to the disposal line 44. The liquids from the third stage centrifuge 64 are directed to a liquids discharge line 68 into a fourth mass flow sensor 70. The mud is then pumped by a pump 72 over a line 74 back to the tank 16 for further use.

It should now be appreciated that the mass flow sensors provide a direct measurement and indication of the operation of the system. For example, the difference between the mass flow through sensor 22 and the sensor 34 provides a direct measurement of the solids discharged into the discharge line 30. Similarly, the difference between mass flow sensed by the sensor 34 and the sensor 46 provides a direct measurement of the solids discharged from the discharge line 40. These measurements can also be translated into a direct measurement of the efficiency of the system in removing low gravity solids from the drilling mud and savings realized by use of the system.

FIG. 1 also shows an alternative embodiment for monitoring the performance of the system. The solids discharges for any or all of the centrifuges 28, 38, 54, and 64 may be directed to a mass flow sensor. The solids discharge of the centrifuge 28 may be directed to a mass flow sensor 29, which is preferably a screw type conveyor or auger with a load cell 31, to measure the high gravity solids being discharged back to the tank 16. Similarly, the solids discharge of the second stage centrifuge 38 may be directed to a mass flow sensor 39 with load cell 41 for measuring solids discharged from the centrifuge 38 overboard. A mass flow sensor 65 with load cell 67 may be provided for centrifuge 64, and a mass flow sensor 57 with load cell 55 may be provided for the cuttings dryer 56. With each of the mass flow sensors 29, 39, 65, and 57, efficiency of each of the centrifuges and the cuttings dryer may be determined by summing the mass flow through sensors at the liquids discharges with the mass flow through sensors at the solids discharges to thereby calculate the total influent, and then calculate the solids removal rate.

Figure 2:
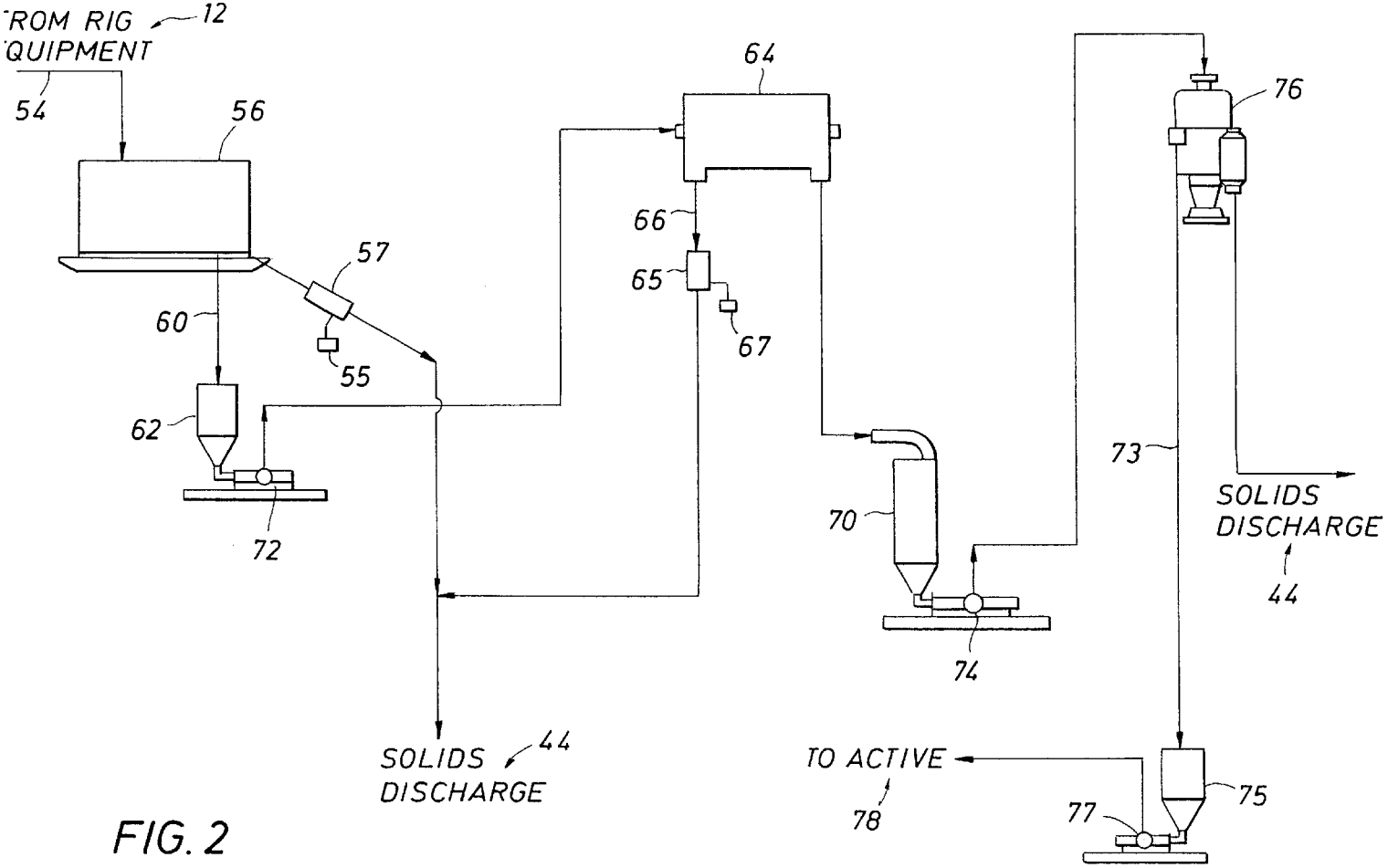
FIG. 2 is a schematic diagram of the system including an additional stage vertical centrifuge.

FIG. 2 depicts another feature that may preferably be included in the system. As previously described, a cuttings dryer 56 receives cuttings from the shakers over an inlet line 54. Liquids from the cuttings dryer are discharged to the fifth mass flow sensor 62, and solids are discharged into a disposal line. The mud is then pumped by a pump 72 to a third stage centrifuge 64. The solids from the third stage centrifuge 64 are discharged to the disposal line 44 and the liquids from the centrifuge 64 are directed to a mass flow sensor 70. At this stage, the drilling mud typically still contains small quantities of very fine cuttings, and such small quantities of very fine cuttings are generally tolerated. However, these cuttings degrade performance of the mud, and are particularly harmful to the system because the finest cuttings are the most abrasive and have the most harmful effect on the viscosity of the mud. The present invention directs the mud from the mass flow sensor 70 with a pump 74 to a de-sludging high speed vertical disc centrifuge 76, available from Hutchison-Hayes as model number SEA-1200. The centrifuge accumulates solids in the bowl, and periodically discharges a quantity of solids for discharge to the disposal line 44. Liquid from the centrifuge 76 is then directed to a mass flow sensor 75 via a line 73, and then returned to the system by a pump 77 through a line 78. In the liquid discharge line from the centrifuge 76, the mud is roughly 0.5% solids, and 99.5% fluid, preferably an oil-based mud.

Figure 3A:
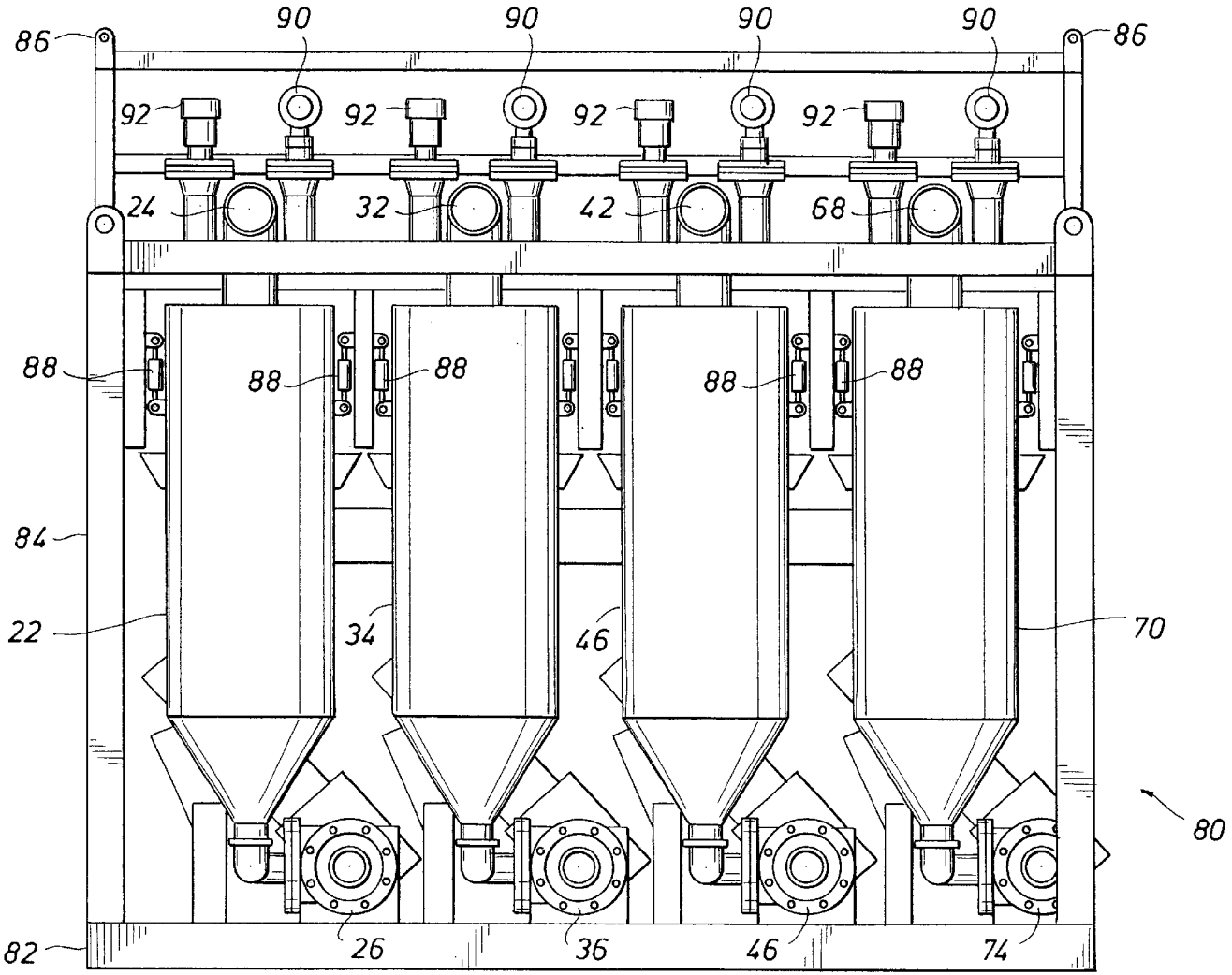
FIG. 3*a* is a front elevation view of a set of in-line mass flow detectors in accordance with this invention.
Figure 3B:
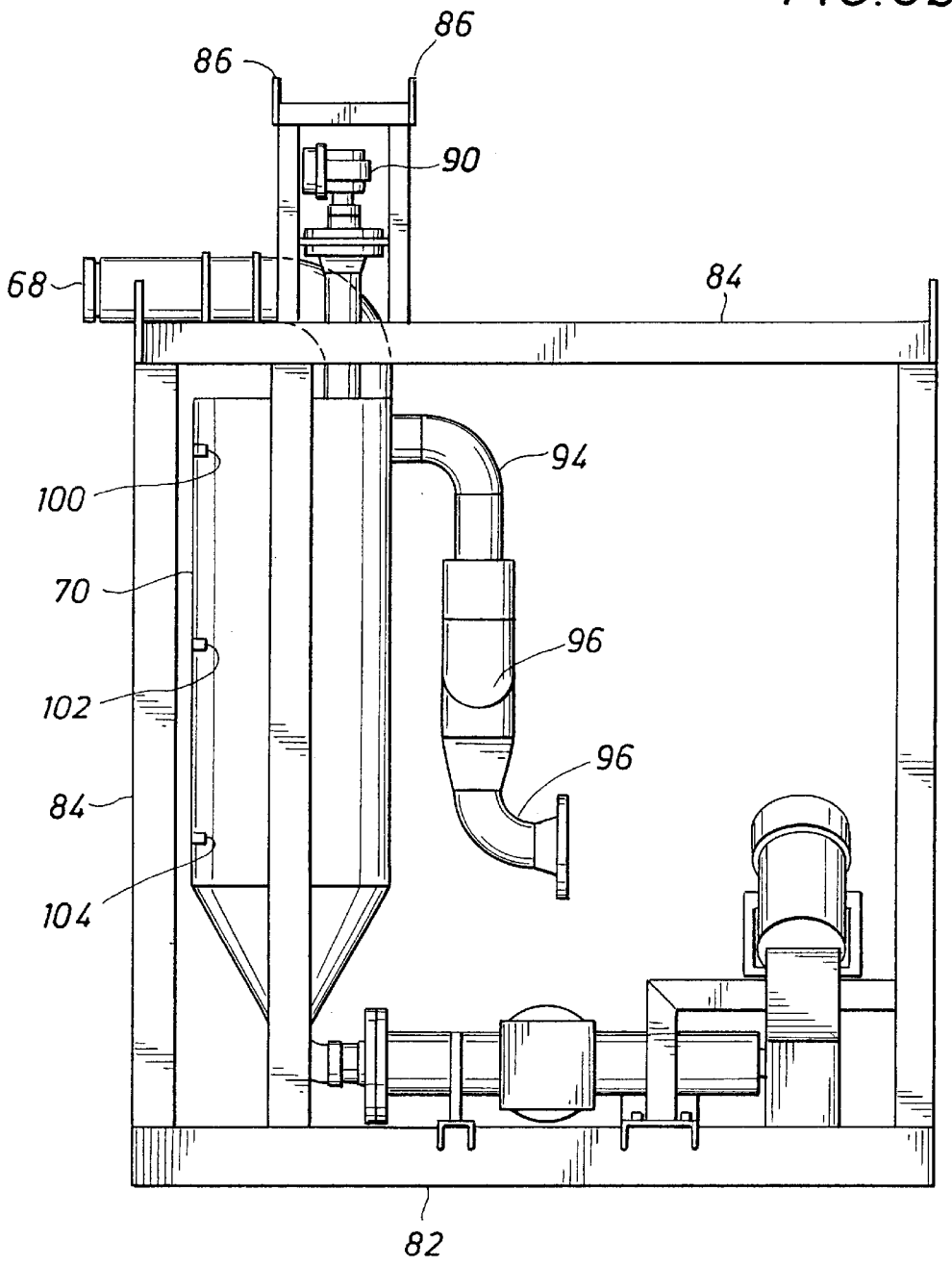
FIG. 3*b* is a side elevation view.
Figure 3C:
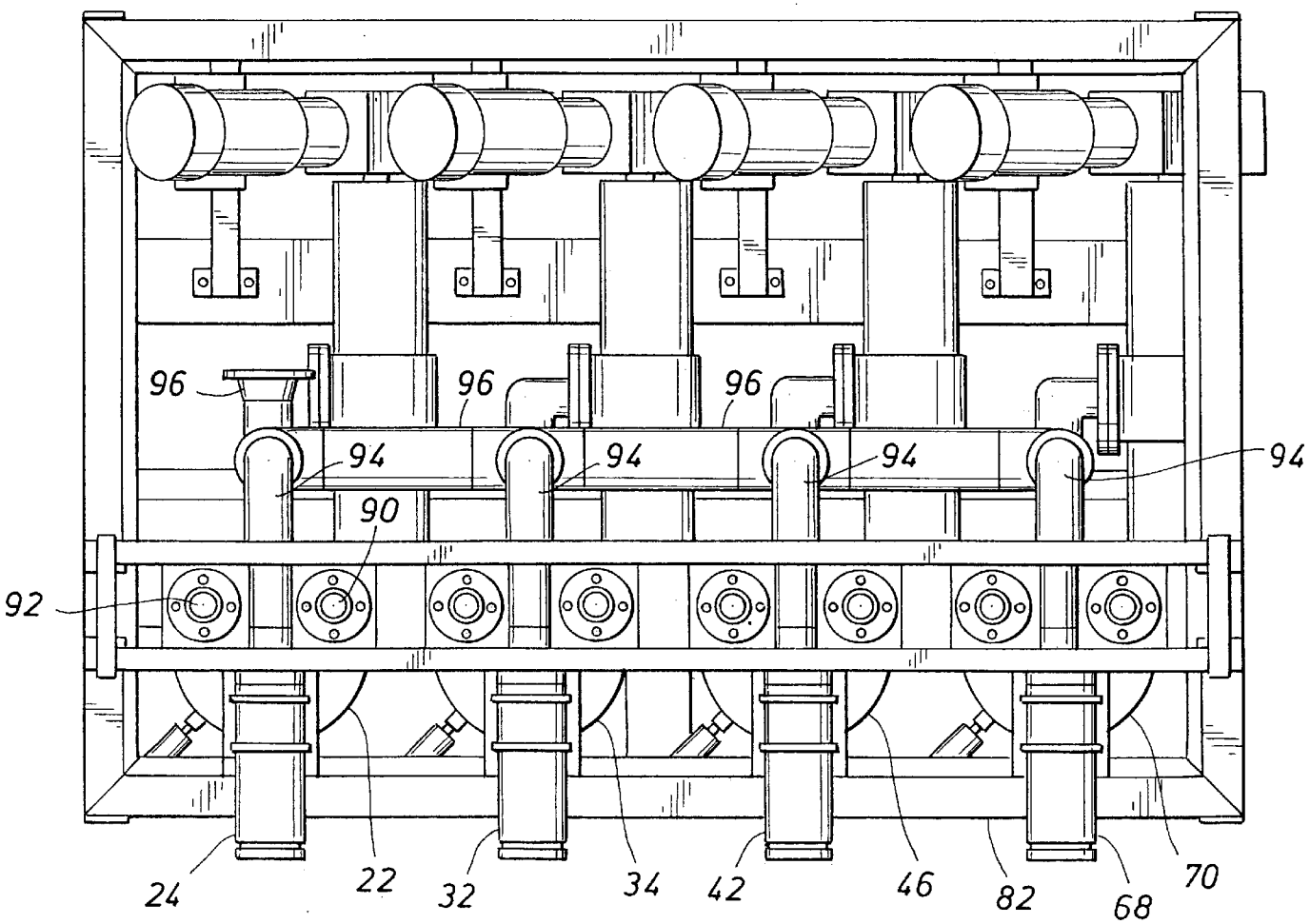
FIG. 3*c* is a top view of the detectors.

FIGS. 3*a,* 3*b,* and 3*c* depict a preferred structure for a bank 80 of mass flow sensors. While FIG. 3*a* shows four such sensors, fewer than four such sensors may be mounted on the frame, such as for example two sensors. To provide perspective, as seen in FIG. 3*a,* the bank of sensors is roughly 7' high and about 10' wide. As seen in FIG. 3*b,* the bank of sensors is about 7' deep. This compact size for the bank of sensors makes is easy to mount all of the sensors on a single platform 82 so that the entire structure may be transported to a drilling rig and mounted thereon. The bank of sensors is supported and surrounded by a frame 84 which includes lifting eyes 86 to assist in transporting the structure.

Referring now to FIG. 3*a,* the sensors 22, 34, 46, and 70 mount to the frame 84 by means of load sensors 88. The load sensors continuously monitor the total weight of each sensor. The sensors discharge into their respective pumps 26, 36, 46, and 74, respectively, as previously described with regard to FIG. 1. The discharges of the pumps are mounted at an angle, as shown in FIG. 3*a,* to minimize the space required for the pumps. Further, the sensors are fed through feed lines 24, 32, 42, and 68, respectively, as shown in FIG. 1. The feed lines and the pump discharges provide the couplings to the remainder of the system 10.

Each sensor is also provided with two level sensors, a radar level detector 90 and an ultra-sonic level detector 92, for accuracy is measuring the total volume of fluid within the sensor.

Referring now to FIG. 3*b,* a side view bank 80 of sensors is provided. From this view, the sensor 70 and its inlet line 68 may be seen mounted in the frame 84. Each of the sensors also includes an overflow line 94 and all four overflow lines 94 flow into a common line 96 which flows back to the storage tank 16 to recover the mud.

To detect mass flow rate in a particular sensor, a high level sensor 100, a nominal level sensor 102, and a low level sensor 104 are provided. With the system operating at steady state, a constant fluid level will be maintained in a sensor. The speed of an associated pump 26, 36, 46, or 74 is then decreased by a predetermined fractional amount. The length of time for fluid level to drop between two level sensors is then timed. This measurement provides an accurate fluid flow rate. The total weight of the sensor is also being constantly measured with the load sensors 88, and together these measurements provide an accurate mass flow rate calculation at steady state.

In addition to the major components just described, the system 10 also includes a number of sensor and control components. All of the pumps and centrifuges are powered from a central electrical power plant, with associated motor controllers for their operation. The operating parameters of the pumps and centrifuges, and all of the other sensor elements for frequency, temperature, level, and load, are also monitored at the same central location. The central location preferably comprises a palletized, air-quality controlled control cabin (not shown) so that the power and control components may also be lifted and transported to the work site. The control cabin further includes redundant computers for fault-tolerant operations of the system. The control cabin preferably includes a bidirectional satellite link to a global communications system, such as the Internet, for command, control, and remote monitoring of the system. This link further provides for remote adjustment of the operating parameters of the system in response to the sensed parameters as needed.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A drilling mud reclamation system comprising:

(a) a mud inlet line adapted to be connected to a source of solids-laden drilling mud;

(b) a first stage centrifuge provided with the mud from the source for separating the heavy weight solid components from the mud and forming a first stage liquid discharge and first stage solids discharge;

(c) a second stage centrifuge provided with the first stage liquid discharge for removing lighter weight solid components in the first stage liquid discharge and for forming a second stage liquid discharge and a second stage solids discharge;

(d) a first in-line mass flow sensor for continuously determining mass flow of drilling mud into the first stage centrifuge; and (e) a second in-line mass flow sensor between the first stage centrifuge and the second stage centrifuge for continuously determining the mass flow rate of the first stage liquid discharge.

2. The system of claim 1 including first and second stage pumps connected to the respective inputs of said first and second stage centrifuges.

3. The system of claim 1, wherein the first in-line mass flow sensor is upstream of the first stage centrifuge.

4. The system of claim 1, wherein the in-line mass flow sensor comprises a fluid tank having a load sensor and a fluid level sensor.

5. The system of claim 4, wherein the fluid level sensor comprises a radar level detector and an ultrasonic level detector.

6. The system of claim 1, further comprising a cuttings dryer to receive mud laden cuttings from a coarse cuttings separator, separate the mud from the cuttings, discharge the cuttings to the second stage solids discharge, and develop a cuttings dryer liquid discharge.

7. The system of claim 6, further comprising a vertical disc, de-sludging centrifuge to receive the cuttings dryer liquid discharge and to remove very fine cuttings from the mud which may adversely effect the viscosity of the mud.

8. The system of claim 1, further comprising a solids mass flow sensor for determining mass flow of a solids discharge at a predetermined location in the system, the solids mass flow sensor comprising a screw conveyor and a load sensor adapted to measure the weight of the conveyor and any contents in the conveyor.

9. The system of claim 8, further comprising a cuttings dryer to receive mud laden cuttings from a coarse cuttings separator, separate the mud from the cuttings, discharge the cuttings to the second stage solids discharge, and develop a cuttings dryer liquid discharge, and wherein the predetermined location of the solids mass flow sensor is upstream of the cuttings dryer.

10. The system of claim 8, wherein the predetermined location of the solids mass flow sensor is at the first stage solids discharge.

11. The system of claim 8, wherein the predetermined location of the solids mass flow sensor is at the second stage solids discharge.

12. The system of claim 8, comprising a cuttings dryer to receive mud laden cuttings from a coarse cuttings separator, separate the mud from the cuttings, discharge the cuttings to the second stage solids discharge, and develop a cuttings dryer liquid discharge, and wherein the predetermined location of the solids mass flow sensor is the cuttings discharge of the cuttings dryer.

13. A drilling mud clarification system comprising:

a. a source of drilling mud to be clarified;

b. a first pump to pump drilling mud from the source;

c. a first in-line mass flow sensor to receive drilling mud from the first pump and to continuously determine mass flow of drilling mud from the first pump;

d. a first centrifuge to receive drilling mud from the first mass flow sensor, to remove high gravity solids from the drilling mud, and to discharge a liquid discharge;

e. a second in-line mass flow sensor to receive the liquid discharge from the first centrifuge and to continuously determine mass flow of liquid discharge from the first centrifuge;

f. a second centrifuge to receive the liquid discharge from the second mass flow sensor, to remove and discharge low gravity solids from the drilling mud, and to discharge a clarified liquid discharge; and g. a third in-line mass flow sensor to receive the clarified liquid discharge from the second centrifuge and to continuously determine mass flow of drilling mud from the second centrifuge.

14. The system of claim 13, further comprising a disposal line to carry the discharged low gravity solids from the second centrifuge.

15. The system of claim 14, further comprising a cuttings dryer to receive mud laden cuttings from a coarse cuttings separator, separate the mud from the cuttings, discharge the cuttings to the disposal line, and develop a cuttings dryer liquid discharge.

16. The system of claim 15, further comprising a cuttings dryer in-line mass flow sensor to measure the mass flow rate of the cuttings dryer liquid discharge.

17. The system of claim 16, further comprising a third centrifuge to receive the cuttings dryer liquid discharge from the cuttings dryer liquid discharge, to remove and discharge low gravity solids from the cuttings dryer liquid discharge, and to develop a third centrifuge liquid discharge.

18. The system of claim 17, further comprising a third centrifuge liquid discharge line to carry the third centrifuge liquid discharge to the source.

19. The system of claim 17, further comprising a de-sludging centrifuge to receive the cuttings dryer liquid discharge and to remove very fine cuttings from the mud which may adversely effect the viscosity of the mud.

20. The system of claim 19, further comprising a de-sludging centrifuge solids discharge line to carry the very fine cuttings from the de-sludging centrifuge to the disposal line.

21. The system of claim 13, wherein each of the mass flow sensors comprises:

a. a fluid tank having a load sensor and a fluid level sensor;

b. an inlet to the fluid tank to receive flowing drilling mud; and c. a pump to pump fluid from the fluid tank.

22. The system of claim 21, wherein the pump in each mass flow sensor is a variable speed, positive displacement pump.

23. The system of claim 21, further comprising an overflow line from each of the fluid tanks.

24. The system of claim 23, wherein each of the overflow lines couples to a common line.

* * * * *